US007905487B2

(12) United States Patent
Milbourne

(10) Patent No.: US 7,905,487 B2
(45) Date of Patent: Mar. 15, 2011

(54) LOTTERY CARD HOLDING AND MARKING APPARATUS AND ASSOCIATED METHOD

(76) Inventor: Paula Milbourne, Millville, NJ (US)

( * ) Notice: Subject to any disclaimer, the term of this patent is extended or adjusted under 35 U.S.C. 154(b) by 477 days.

(21) Appl. No.: 11/986,452

(22) Filed: Nov. 23, 2007

(65) Prior Publication Data

US 2009/0134579 A1 May 28, 2009

(51) Int. Cl.
*A63F 11/00* (2006.01)

(52) U.S. Cl. ..... 273/309; 273/148 R

(58) Field of Classification Search ..... 273/309, 273/148 R

See application file for complete search history.

(56) References Cited

U.S. PATENT DOCUMENTS 4,662,526 A 8/1987 Chiappetta
D313,313 S 1/1991 Folino
5,127,720 A * 7/1992 Shultz ..... 312/229
D328,526 S 8/1992 Bianchi, Jr.
5,491,324 A * 2/1996 Vanderpool ..... 235/90
2006/0060746 A1* 3/2006 Hsu ..... 248/444
2006/0220311 A1* 10/2006 Campbell ..... 273/148 R
2006/0278540 A1* 12/2006 Schacht ..... 206/39

* cited by examiner

*Primary Examiner* — Gene Kim
*Assistant Examiner* — Michael D Dennis

(57) ABSTRACT

An apparatus for holding and marking a lottery ticket during playing conditions includes a base plate with a planar top surface provided with upwardly extending walls contiguously surrounding a periphery thereof. A lid is pivotally coupled to the base plate in such a manner that the lid and base plate pivot about a fulcrum axis extending along respective proximal latitudinal edges of the lid and the base plate. The apparatus further includes a plurality of brackets attached to opposed ones of the walls of the lid. Each of such brackets is linearly slidable along a corresponding edge of the lid, and the brackets are slidable along mutually exclusive linear paths defined along the corresponding lids respectively. The apparatus further includes a scratching implement removably coupled to one of the brackets, and a marking implement removably coupled to another one of the brackets.

10 Claims, 3 Drawing Sheets

LOTTERY CARD HOLDING AND MARKING APPARATUS AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lottery card holding apparatuses and, more particularly, to a lottery card holding and marking apparatus for holding and marking a lottery ticket during playing conditions.

2. Prior Art

One reason for the great popularity of scratch-off lottery tickets is that they are freely accessible. The lottery ticket is unique in that unlike other games of chance, such as bingo or any variety of casino games, the product is in the form of a ticket which comes to the consumer, not vice versa. That is to say, scratch-off lottery tickets are sold at establishments such as convenience stores, liquor stores, filling stations, as well as other retail outlets. The buyer of such tickets usually makes his or her purchase as an afterthought, with the ticket usually being bought because it, as well as change in the form of cash, happened to be available at the checkout counter of an establishment which the purchaser patronized. Establishments such as those listed above generally have certain characteristics in common: a steady stream of people, little or no privacy afforded the patron, and a limited amount of area or space.

Another unique aspect of the lottery ticket is the desire of many purchasers to be afforded at least some degree of privacy when conducting the act of exposing the ticket's variables. While there are no known scientific studies which have explored this phenomena, it is reasonable to assume that the typical purchaser does not wish for a stranger to witness the results of his or her gamble for fear that he or she will look the part of a fool when it is shown that his or her lottery ticket yielded the purchaser nothing. Alternatively, the purchaser may fear that he or she will appear foolish if, for example, he or she becomes excited when a token sum is won and reinvested at once in more tickets, on the hope that one of them may contain the numbers or symbols needed to win the maximum lottery prize. One optimal place to be afforded the desired space, comfort, and privacy needed to enjoy and appreciate the act of exposing lottery tickets is the inside of the parked or otherwise disengaged automobile driven by the purchaser to the filling station, convenience store, or liquor store.

Unfortunately, scratch-off lottery cards usually employ a latex type surface layer which is to be scraped to expose the hidden indicia. The resulting residue is not only unsightly, but is difficult to remove from fabric and upholstery as well. Further, unless the buyer of the ticket has a hard surface such as a book or the like upon which to scrape the ticket, he or she will likely use, out of necessity, a clumsy surface such as the dash-board or one's knee for under support. Thus, the hard-to-clean residue may end up on the car seat, in the fabric of one's clothes, or in the car's carpeted floor. What is needed is a device which allows for accommodation of one's desire to play the lottery in the privacy while ensuring that by doing so, he or she will not become uncomfortable by not having a solid surface on which to write or scratch on the surface of a lottery ticket.

U.S. Pat. No. 4,662,518 to Chiappetta discloses an invention that is designed to use with lottery tickets. It includes a container to hold at least ten lottery tickets. The container houses a scraper designed to remove the coating from the tickets, a protective lip which covers the "void if removed" section of the ticket, and a slot to allow for easy disposal of the residue coating through the bottom of the container. Unfortunately, this prior art example does not include a surface specifically designed for supporting a lottery ticket during playing conditions.

U.S. Pat. No. 5,127,720 to Shultz discloses a lottery ticket scratch tray provided to promote the clean and efficient removal of opaque coverings shielding lottery ticket variables. The device includes a square or rectangularly shaped smooth surface surrounded by four walls. Built into the device is a slot through which debris from spent tickets may be deposited. This debris stored beneath the smooth surface and may be disposed of through the removal of a slidable drawer which serves as the storage compartment. The device further contains a novel hook-and-loop fastening system to aid in the storage of the device. Unfortunately, this prior art example does not assist a user in playing all types of lottery tickets.

Accordingly, the present invention is disclosed in order to overcome the above noted shortcomings. The present invention is convenient and easy to use, lightweight yet durable in design, and designed for holding and marking a lottery ticket during playing conditions. The lottery card holding and marking apparatus is simple to use, inexpensive, and designed for man years of repeated use.

BRIEF SUMMARY OF THE INVENTION

In view of the foregoing background, it is therefore an object of the present invention to provide an apparatus for holding and marking a lottery ticket during playing conditions. These and other objects, features, and advantages of the invention are provided by a lottery card holding and marking apparatus.

An apparatus for holding and marking a lottery ticket during playing conditions includes a base plate with a planar top surface provided with upwardly extending walls contiguously surrounding a periphery thereof. Such walls are monolithically formed with each other and registered orthogonal to the bottom surface wherein the walls terminate above the bottom surface. The base plate includes a mechanism for telescopically adjusting a longitudinal length thereof in such a manner that a latitudinal length of the base plate remains unchanged as the longitudinal length is selectively shortened and lengthened respectively. Such a telescopically adjusting mechanism includes a female member and a male member directly abutted against at least three contiguously facing sides of the female member such that the male member is effectively extendable and retractable while the female member is maintained at a static position.

A lid is pivotally coupled to the base plate in such a manner that the lid and base plate pivot about a fulcrum axis extending along respective proximal latitudinal edges of the lid and the base plate. Such a lid has downwardly extending walls contiguously surrounding a periphery thereof. Such walls are monolithically formed with each other and registered orthogonal to the bottom surface wherein the walls conveniently terminate subjacent to the bottom surface. The lid includes a mechanism for telescopically adjusting a longitudinal length thereof in such a manner that a latitudinal length of the lid remains unchanged as the longitudinal length is selectively shortened and lengthened respectively.

The lid is provided with an upwardly protruding shoulder orthogonally registered with the top surface of the lid, and the shoulder is registered parallel to the fulcrum axis. The female member of the base member is directly engaged with the male and female members of the lid when the lid is advantageously articulated downwardly to a closed position with the base member.

The apparatus further includes a plurality of brackets attached to opposed ones of the walls of the lid. Each of such brackets is linearly slidable along a corresponding edge of the lid, and the brackets are effectively slidable along mutually exclusive linear paths defined along the corresponding lids respectively. The apparatus further includes a scratching implement removably coupled to one of the brackets, and a marking implement removably coupled to another one of the brackets. Such scratching and marking implements lay parallel to longitudinal edges of the lid.

A method for holding and marking a lottery ticket during playing conditions includes the steps of: providing a base plate with a planar top surface including upwardly extending walls contiguously surrounding a periphery thereof; pivotally coupling a lid to the base plate in such a manner that the lid and base plate pivot about a fulcrum axis extending along respective proximal latitudinal edges of the lid and the base plate; attaching a plurality of brackets to opposed ones of the walls of the lid; removably coupling a scratching implement to one of the brackets; removably coupling a marking implement to another one of the brackets; and laying the scratching and marking implement parallel to longitudinal edges of the lid.

The method further includes the steps of: telescopically adjusting a longitudinal length of the base member in such a manner that a latitudinal length of the base plate remains unchanged as the longitudinal length is selectively shortened and lengthened respectively; telescopically adjusting a longitudinal length of the lid in such a manner that a latitudinal length of the lid remains unchanged as the longitudinal length is selectively shortened and lengthened respectively; and linearly sliding each of the brackets along mutually exclusive linear paths defined along a corresponding edge of the lid.

The method further includes the steps of: providing a female member; and directly abutting a male member against at least three contiguously facing sides of the female member such that the male member is extendable and retractable while the female member is maintained at a static position.

The method further includes the steps of: providing a female member; directly abutting a male member against at least three contiguously facing sides of the female member such that the male member is extendable and retractable while the female member is maintained at a static position; and directly engaging the female member of the base member with the male and female members of the lid when the lid is articulated downwardly to a closed position with the base member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
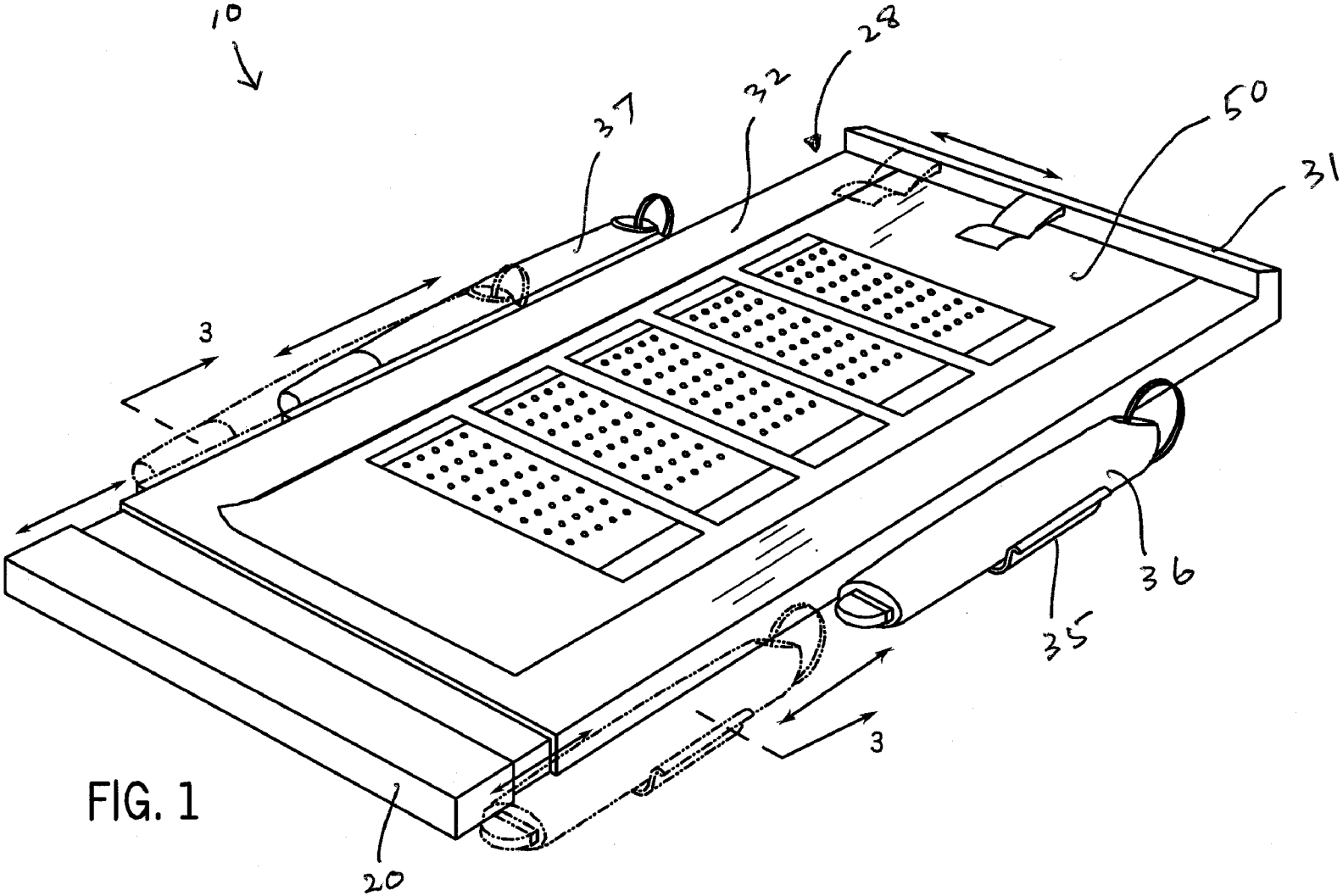
FIG. 1 is a perspective view showing an apparatus for holding and marking a lottery ticket, indicating the removability of the scratching and marking implements, in accordance with the present invention.
Figure 2:
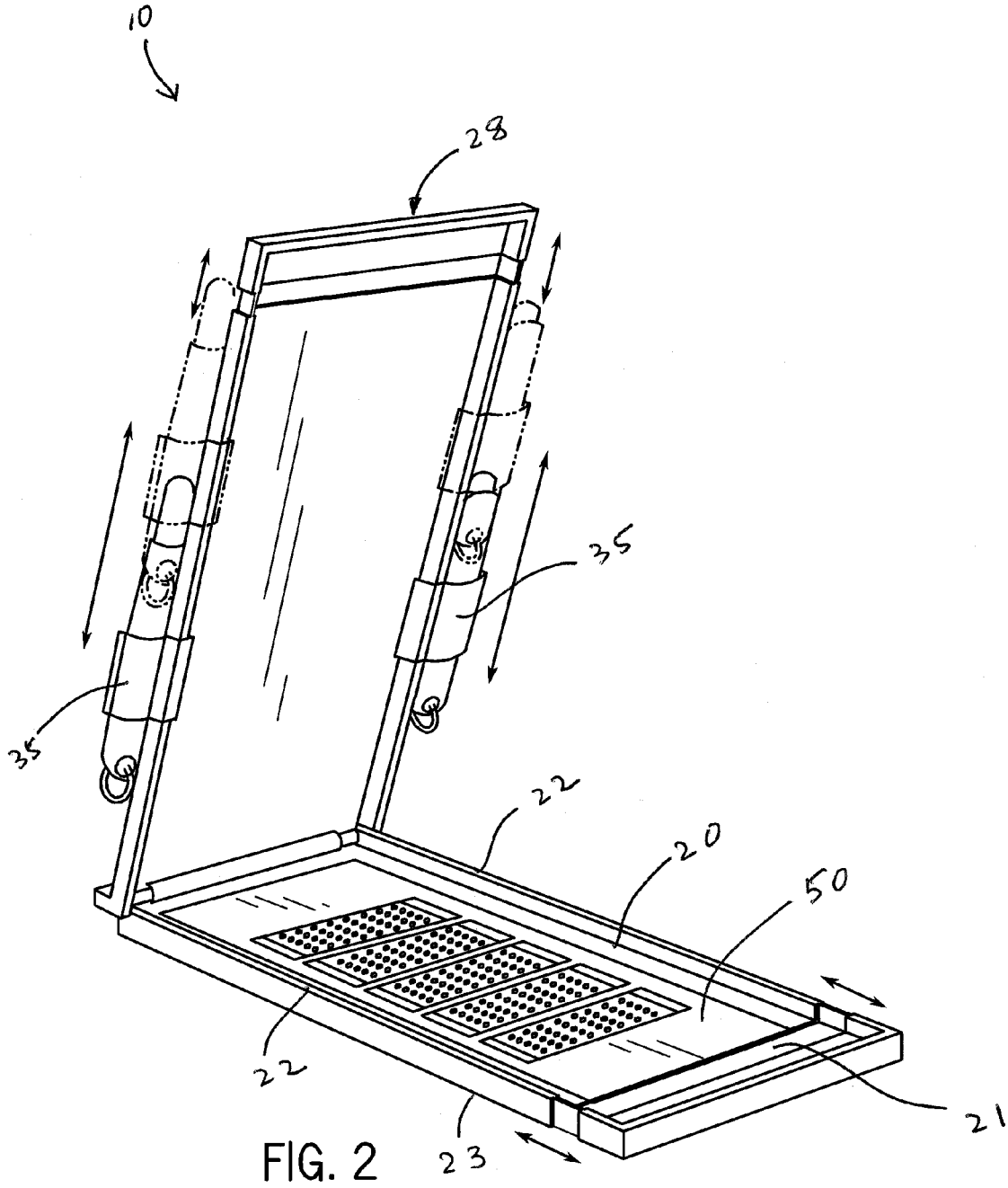
FIG. 2 is a perspective view of the apparatus, with the lid in an open position, in accordance with the present invention.
Figure 3:
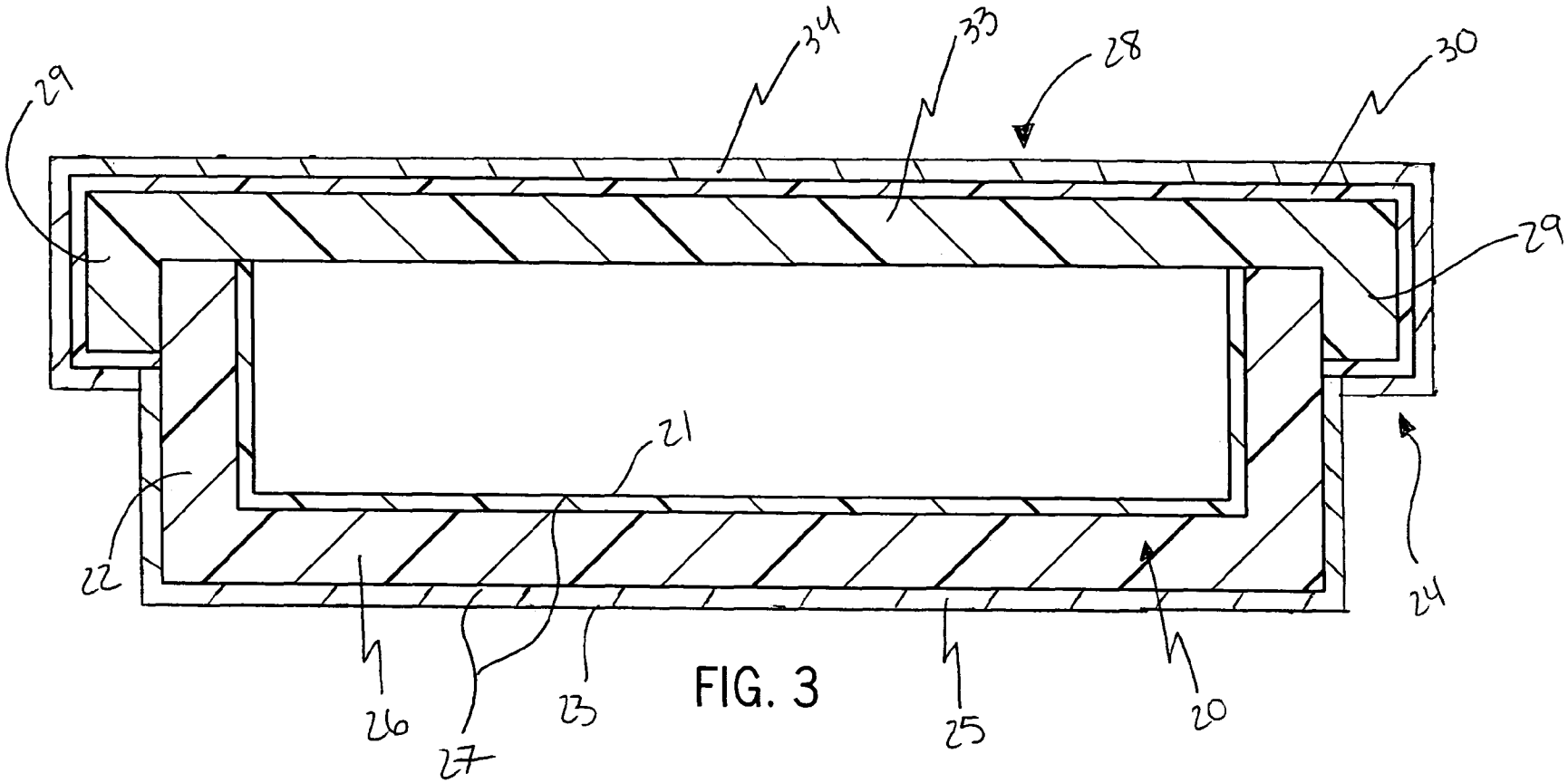
FIG. 3 is a cross sectional view of the apparatus, taken along line 3-3, as seen in FIG. 1.

The apparatus of this invention is referred to generally in FIGS. 1-3 by the reference numeral 10 and is intended to protect an apparatus for holding and marking a lottery ticket. It should be understood that the apparatus 10 may be used to hold and mark many different types of tickets and should not be limited in use with only those tickets mentioned herein.

Referring initially to FIGS. 2 and 3, an apparatus 10 for holding and marking a lottery ticket during playing conditions includes a base plate 20 with a planar top surface 21 provided with upwardly extending walls 22 contiguously surrounding a periphery thereof. Such walls 22 are monolithically formed with each other and registered orthogonal to the bottom surface 23 wherein the walls 22 terminate above the bottom surface 23. The base plate 20 includes a mechanism 24 for telescopically adjusting a longitudinal length thereof in such a manner that a latitudinal length of the base plate 20 remains unchanged as the longitudinal length is selectively shortened and lengthened respectively. Such a telescopically adjusting mechanism 24 includes a female member 25 and a male member 26 directly abutted, without the use of intervening elements, against at least three contiguously facing sides 27 of the female member 25 which is essential such that the male member 26 is extendable and retractable while the female member 25 is maintained at a static position. The base plate 20 provides a housing for storing extra lottery tickets.

Referring to FIGS. 1, 2 and 3, a lid 28 is pivotally coupled to the base plate 20 in such a manner that the lid 28 and base plate 20 pivot about a fulcrum axis extending along respective proximal latitudinal edges of the lid 28 and the base plate 20. Such a lid 28 has downwardly extending walls 29 contiguously surrounding a periphery thereof. Such walls 29 are monolithically formed with each other and registered orthogonal to the bottom surface 23 wherein the walls 29 terminate subjacent to the bottom surface 23. The lid 28 includes a mechanism 30 for telescopically adjusting a longitudinal length thereof in such a manner that a latitudinal length of the lid 28 remains unchanged as the longitudinal length is selectively shortened and lengthened respectively.

The lid 28 is provided with an upwardly protruding shoulder 31 orthogonally registered with the top surface 32 of the lid 28, and the shoulder 31 is registered parallel to the fulcrum axis. The female member 25 of the base member 20 is directly engaged, without the use of intervening elements, with the male and female members 33, 34 of the lid 28 when the lid 28 is articulated downwardly to a closed position with the base member 20. The lid 28 provides the dual purpose of ensuring that the tickets 50 in the base plate 20 remain in place and also provides a surface for supporting a user's lottery ticket 50 while playing the ticket.

Referring to FIGS. 1 and 2, the apparatus 10 further includes a plurality of brackets 35 attached to opposed ones of the walls 29 of the lid 28. Each of such brackets 35 is linearly slidable along a corresponding edge of the lid 28, and the brackets 35 are slidable along mutually exclusive linear paths defined along the corresponding lids 28 respectively. The apparatus 10 further includes a scratching implement 36 removably coupled to one of the brackets 35, and a marking implement 37 removably coupled to another one of the brackets 35. Such scratching and marking implements 36, 37 lay parallel to longitudinal edges of the lid 28. The brackets 35 are provided for conveniently holding the scratching and marking implements 36, 37 thereby ensuring that the implements are not accidentally lost.

The present invention, as claimed, provides the unexpected and unpredictable benefit of an apparatus for holding and marking a lottery ticket that provides a user a firm backing when marking tickets or removing material from scratch off lottery tickets, and a handy storage compartment for storing extra lotto tickets. The apparatus further provides an all-in-one unit that makes playing the lottery less time consuming and more convenient. The apparatus for holding and marking a lottery ticket is a beneficial tool for all those who buy lotto tickets and play the lottery.

In use, a method for holding and marking a lottery ticket 50 during playing conditions includes the steps of: providing a base plate 20 with a planar top surface 21 including upwardly extending walls 22 contiguously surrounding a periphery thereof; pivotally coupling a lid 28 to the base plate 20 in such a manner that the lid 28 and base plate 20 pivot about a fulcrum axis extending along respective proximal latitudinal edges of the lid 28 and the base plate 20; attaching a plurality of brackets 35 to opposed ones of the walls of the lid 28; removably coupling a scratching implement 36 to one of the brackets 35; removably coupling a marking implement 37 to another one of the brackets 35; and laying the scratching and marking implement 36, 37 parallel to longitudinal edges of the lid 28.

In use, the method further includes the steps of: telescopically adjusting a longitudinal length of the base member 20 in such a manner that a latitudinal length of the base plate 20 remains unchanged as the longitudinal length is selectively shortened and lengthened respectively; telescopically adjusting a longitudinal length of the lid 28 in such a manner that a latitudinal length of the lid 28 remains unchanged as the longitudinal length is selectively shortened and lengthened respectively; and linearly sliding each of the brackets 35 along mutually exclusive linear paths defined along a corresponding edge of the lid 28.

In use, the method further includes the steps of: providing a female member 25; and directly abutting, without the use of intervening elements, a male member 26 against at least three contiguously facing sides of the female member 25 such that the male member 26 is extendable and retractable while the female member 25 is maintained at a static position.

In use, the method further includes the steps of: providing a female member 34; directly abutting, without the use of intervening elements, a male member 33 against at least three contiguously facing sides of the female member 34 such that the male member 33 is extendable and retractable while the female member 34 is maintained at a static position; and directly engaging, without the use of intervening elements, the female member 25 of the base member 20 with the male and female members 33, 34 of the lid 28 when the lid 28 is articulated downwardly to a closed position with the base member 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for holding and marking a lottery ticket during playing conditions, said apparatus comprising: a base plate having a planar top surface provided with upwardly extending walls contiguously surrounding a periphery thereof, said walls being monolithically formed with each other and registered orthogonal to said top surface wherein said walls terminate above said top surface; a lid pivotally coupled to said base plate in such a manner that said lid and base plate pivot about a fulcrum axis extending along respective proximal latitudinal edges of said lid and said base plate, said lid having downwardly extending walls contiguously surrounding a periphery thereof, said walls being monolithically formed with each other and registered orthogonal to a bottom surface of said lid wherein said walls terminate subjacent to said bottom surface; a plurality of brackets attached to opposed ones of said walls of said lid; a scratching implement removably coupled to one of said brackets; and a marking implement removably coupled to another one of said brackets; wherein said scratching and marking implement lay parallel to longitudinal edges of said lid; wherein said top surface is directly connected to said walls of said base plate; wherein said bottom surface is planar and directly connected to said walls of said lid; wherein each of said brackets is linearly slidable along a corresponding edge of said lid, said brackets being slidable along mutually exclusive linear paths defined along said corresponding lids respectively.

2. The apparatus of claim 1, wherein said base plate comprises:

means for telescopically adjusting a longitudinal length thereof in such a manner that a latitudinal length of said base plate remains unchanged as the longitudinal length is selectively shortened and lengthened respectively.

3. The apparatus of claim 1, wherein said lid comprises:

means for telescopically adjusting a longitudinal length thereof in such a manner that a latitudinal length of said lid remains unchanged as the longitudinal length is selectively shortened and lengthened respectively.

4. The apparatus of claim 2, wherein said telescopically adjusting means comprises: a female member and a male member directly abutted against at least three contiguously facing sides of said female member such that said male member is extendable and retractable while said female member is maintained at a static position.

5. The apparatus of claim 4, wherein said telescopically adjusting means comprises: a female member and a male member directly abutted against at least three contiguously facing sides of said female member such that said male member is extendable and retractable while said female member is maintained at a static position;

wherein said female member of said base member is directly engaged with said male and female members of said lid when said lid is articulated downwardly to a closed position with said base member.

6. An apparatus for holding and marking a lottery ticket during playing conditions, said apparatus comprising: a base plate having a planar top surface provided with upwardly extending walls contiguously surrounding a periphery thereof, said walls being monolithically formed with each other and registered orthogonal to said top surface wherein said walls terminate above said top surface; a lid pivotally coupled to said base plate in such a manner that said lid and base plate pivot about a fulcrum axis extending along respective proximal latitudinal edges of said lid and said base plate, said lid having downwardly extending walls contiguously surrounding a periphery thereof, said walls being monolithically formed with each other and registered orthogonal to a bottom surface of said lid wherein said walls terminate subjacent to said bottom surface; a plurality of brackets attached to opposed ones of said walls of said lid; a scratching implement removably coupled to one of said brackets; and a marking implement removably coupled to another one of said brackets; wherein said scratching and marking implement lay parallel to longitudinal edges of said lid; wherein said lid is provided with an upwardly protruding shoulder orthogonally registered with said top surface of said lid, said shoulder being registered parallel to the fulcrum axis; wherein said top surface is directly connected to said walls of said base plate; wherein said bottom surface is planar and directly connected to said walls of said lid; wherein each of said brackets is linearly slidable along a corresponding edge of said lid, said brackets being slidable along mutually exclusive linear paths defined along said corresponding lids respectively.

7. The apparatus of claim 6, wherein said base plate comprises:

means for telescopically adjusting a longitudinal length thereof in such a manner that a latitudinal length of said base plate remains unchanged as the longitudinal length is selectively shortened and lengthened respectively.

8. The apparatus of claim 6, wherein said lid comprises:

means for telescopically adjusting a longitudinal length thereof in such a manner that a latitudinal length of said lid remains unchanged as the longitudinal length is selectively shortened and lengthened respectively.

9. The apparatus of claim 7, wherein said telescopically adjusting means comprises: a female member and a male member directly abutted against at least three contiguously facing sides of said female member such that said male member is extendable and retractable while said female member is maintained at a static position.

10. The apparatus of claim 9, wherein said telescopically adjusting means comprises: a female member and a male member directly abutted against at least three contiguously facing sides of said female member such that said male member is extendable and retractable while said female member is maintained at a static position;

wherein said female member of said base member is directly engaged with said male and female members of said lid when said lid is articulated downwardly to a closed position with said base member.

* * * * *